US006327444B1

(12) United States Patent
Hachisuga

(10) Patent No.: US 6,327,444 B1
(45) Date of Patent: Dec. 4, 2001

(54) FIXING DEVICE AND HEATING VOLUME REGULATING METHOD FOR AN IMAGE FORMING APPARATUS

(75) Inventor: Takaaki Hachisuga, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/587,278

(22) Filed: Jun. 5, 2000

(51) Int. Cl.[7] ..... G03G 15/00

(52) U.S. Cl. ..... 399/45; 219/216; 399/322; 399/329

(58) Field of Search ..... 219/216; 399/45, 399/67, 68, 322, 324, 328, 329, 332, 400

(56) References Cited

U.S. PATENT DOCUMENTS 5,895,152 * 4/1999 Ide et al. ..... 399/322

FOREIGN PATENT DOCUMENTS 6-318001 11/1994 (JP) .

* cited by examiner

*Primary Examiner*—Sophia S. Chen
*Assistant Examiner*—Hoang Ngo
(74) *Attorney, Agent, or Firm*—Foley & Lardner

(57) ABSTRACT

The fixing device of the present invention is provided in the conveying path to lead an image receiving medium having a developer image in the exit direction and includes a pressurizing/fixing roller pair for pressurizing and fixing the developer image by holding the image receiving medium, an endless belt shaped fixing belt having a first heater for heating and fusing the developer image in the conveying path before arriving at the fixing rollers, and an adjusting device for adjusting a gap between the image receiving medium and the fixing belt according to the characteristic of the image receiving medium passing the conveying path. Further, when the fixing belt overlaps a paper conveying unit for conveying a paper, a separating means is included for separating the fixing belt from the paper conveying unit when the fixing belt is not in the fixing operation.

20 Claims, 5 Drawing Sheets

FIXING PERFORMANCE OF ORDINARY PAPER (GAP IS 10mm)

| ITEM | TEMPERATURE OF HEAT ROOLER | TEMPERATURE OF 2ND FIXING ROOLER | FIXING PERFORMANCE | OFFSET | JAM |
|---|---|---|---|---|---|
| ① | 140℃ | 130℃ | △ | ○ | NO |
| ② | 150℃ | 140℃ | ○ | ○ | NO |
| ③ | 160℃ | 150℃ | ○ | ○ | NO |
| ④ | 170℃ | 160℃ | ○ | △ | NO |

FIG. 4

FIXING PERFORMANCE OF THICK PAPER 1

| ITEM | GAP G1 | TEMPERATURE OF HEAT ROOLER | TEMPERATURE OF 2ND FIXING ROOLER | FIXING PERFORMANCE | OFFSET | JAM |
|---|---|---|---|---|---|---|
| ① | 10 mm | 180℃ | 170℃ | ○ | ○ | NO |
| ② | 9 mm | 170℃ | 160℃ | ○ | ○ | NO |
| ③ | 8 mm | 165℃ | 155℃ | ○ | ○ | NO |
| ④ | 7 mm | 160℃ | 150℃ | ○ | ○ | NO |
| ⑤ | 6 mm | 155℃ | 145℃ | ○ | ○ | NO |

FIG. 5

FIXING PERFORMANCE OF THICK PAPER 2

| ITEM | GAP G1 | TEMPERATURE OF HEAT ROOLER | TEMPERATURE OF 2ND FIXING ROOLER | FIXING PERFORMANCE | OFFSET | JAM |
|---|---|---|---|---|---|---|
| ① | 10 mm | 200℃ | 190℃ | △ | ○ | NO |
| ② | 9 mm | 200℃ | 190℃ | ○ | ○ | NO |
| ③ | 8 mm | 180℃ | 170℃ | ○ | ○ | NO |
| ④ | 7 mm | 170℃ | 160℃ | ○ | ○ | NO |
| ⑤ | 6 mm | 165℃ | 155℃ | ○ | ○ | NO |
| ⑥ | 5 mm | 160℃ | 150℃ | ○ | ○ | NO |
| ⑦ | 4 mm | 155℃ | 145℃ | ○ | ○ | NO |
| ⑧ | 3 mm | 150℃ | 140℃ | ○ | ○ | NO |

FIG. 6

FIXING PERFORMANCE OF THICK PAPER 3

| ITEM | GAP G1 | TEMPERATURE OF HEAT ROOLER | TEMPERATURE OF 2ND FIXING ROOLER | FIXING PERFORMANCE | OFFSET | JAM |
|---|---|---|---|---|---|---|
| ① | 10 mm | 200℃ | 190℃ | × | ○ | YES |
| ② | 9 mm | 200℃ | 190℃ | × | ○ | YES |
| ③ | 8 mm | 200℃ | 190℃ | △ | ○ | NO |
| ④ | 7 mm | 200℃ | 190℃ | ○ | ○ | NO |
| ⑤ | 6 mm | 190℃ | 180℃ | ○ | ○ | NO |
| ⑥ | 5 mm | 180℃ | 170℃ | ○ | ○ | NO |
| ⑦ | 4 mm | 170℃ | 160℃ | ○ | ○ | NO |
| ⑧ | 3 mm | 160℃ | 150℃ | ○ | ○ | NO |

FIG. 7

FIXING DEVICE AND HEATING VOLUME REGULATING METHOD FOR AN IMAGE FORMING APPARATUS

BACKGROUND OF THE INVENTION

1. Field of the Invention

The present invention relates to a fixing device for fixing a developer image formed on an image receiving medium by heating and pressurizing a developer image by fixing rollers after heating and fusing the developer image by a fixing belt and a heating volume regulating method.

2. Description of the Related Art

For a fixing device that is used in an electro-photographic type copying machine, printer and the like for heating, pressurizing and fixing a toner image that is formed on a paper, a heat roller type fixing device for simultaneously heating and pressurizing a toner image by inserting a paper between a pair of fixing rollers having a heater or a belt type fixing device for heating, pressurizing and fixing a toner image by inserting a paper between a pair of fixing rollers after sufficiently heating and fusing a toner image formed on a paper by an endless belt shaped fixing belt is used.

On the other hand, a full color electro-photographic type image forming apparatus has come into wide use in recent years. This type of full color image forming apparatus uses paper in a wide range of thickness and also uses OHP paper, etc. and therefore, a high fixing property is demanded in order for achieving good color reproducibility for paper having various kinds of characteristics.

In order to obtain good full color reproducibility on such various kinds of paper, a fixing speed of a fixing device is so far controlled according to characteristics of paper or a heating temperature of a fixing device is controlled according to the characteristic of paper as disclosed in the Japanese Patent No. 10-274903.

However, in the case of a fixing device that controls a fixing speed, if a fixing speed was retarded by about 50%, the number of sheets to be copied will decrease by half and the performance drops as a result of the decrease in the number of copies. Furthermore, when intends to control a fixing speed only while maintaining other image forming processes unchanged, a distance from a peeling device to a fixing device requires at least a length of, for instance, A 3 size, that is the maximum paper size and the size of a fixing device will become large.

On the other hand, in the case of a heat roller type fixing device to control a fixing temperature, when paper in the range of, for instance, 80 g/m$^2$~209 g/m$^2$ is usable, the paper thickness is classified into 4 kinds; ordinary paper of 80 g/m$^2$~90 g/m$^2$, thick paper 1 of 91 g/m$^2$~105 g/m$^2$, thick paper 2 of 106 g/m$^2$~140 g/m$^2$ and thick paper 3 of 141 g/m$^2$–209 g/m$^2$ and a fixing temperature of the fixing roller is controlled at 4 stages of 155° C., 165° C., 170° C. and 180° C. according to the classification of paper thickness.

As a definite example, when intended to change the image forming mode to the image forming mode for ordinary paper (80 g/m$^2$~90 g/m$^2$) immediately after completing the copying in the image forming mode for thick paper 3 (141 g/m$^2$~209 g/m$^2$), the fixing temperature of the fixing roller must be controlled to lower by 25° C. from 180° C. for the thick paper 3 to 155° C. for the ordinary paper. Normally, to lower a temperature of the fixing roller pair by 25° C., a time of about 3.5 min. is required even if the temperature is positively lowered by rotating the fixing roller pair. Therefore, operator must wait for a long time until the fixing roller reaches a proper temperature, the operability is lowered and furthermore, in order to control the fixing roller temperature positively, the fixing roller must be rotated even during the non-fixing time, and the life of the fixing roller is shortened.

Further, to improve the full color reproducibility of a belt type fixing device, it is necessary to sufficiently heat and fuse a toner by the fixing belt before pressurizing and fixing the toner by the fixing roller. So, in order to give a sufficient volume of heat to a toner, it is required to surely control the temperature of the fixing belt or secure a sufficient heating/fusing time using a long fixing belt.

Therefore, when intends to surely control the temperature of the fixing belt, a waiting time until the fixing belt reaches a proper fixing temperature when changing over the image forming mode will become long and the operability is deteriorated.

On the other hand, when the fixing belt is arranged to overlap the paper conveying unit to the fixing unit to downsize the main body of the fixing device when a long fixing belt is used, it was necessary to drive the paper conveying unit in order to prevent the deformation of the paper conveying unit by the heating from the fixing belt even when no paper is conveyed. Furthermore, in the case of a fixing device in which the paper conveying unit and the photosensitive drum are driven synchronously, the photosensitive drum must be driven jointly with the paper conveying unit as long as the fixing belt is heated even during the warming-up. Thus, the life of the paper conveying unit and the photosensitive drum was shortened and cost was increased.

Accordingly, in the case of a belt type fixing device, when an image forming mode is changed over so as to get good full color reproducibility regardless of the characteristic of a paper, it is desirable to be able to obtain the good operability without requiring a long waiting time and furthermore, to extend the life of the fixing device. Further, in the case of a belt type fixing device, it is desirable that the life of the paper conveying unit and the photosensitive drum is extended without impeding the downsizing of the main body of the device when a long fixing belt is used so as to get good full color reproducibility.

SUMMARY OF THE INVENTION

An object of the present invention is to obtain good full color image reproducibility without deteriorating the performance of the device due to decrease in the number of sheets to be copied when performing the image fixing suited to the characteristic of a paper.

Another object of the present invention is also to achieve good full color image reproducibility and obtain the high operability in a short waiting time irrespective of the image forming mode change-over to adapt to various kinds of paper.

A further object of the present invention is to extend the life of processing devices around the fixing device and reduce cost accordingly when intending the downsizing of the main body of the fixing device irrespective of use of a long fixing belt in order for sufficiently heating and fusing a toner image.

According to the present invention, there is provided a fixing device comprising pressuring/fixing means that is provided in a conveying path for leading an image receiving medium having a developer image in the exit direction for pressuring/fixing the developer image by holding the image receiving medium; endless belt shaped heating/fusing means having a first heating means for heating/fusing the developer image in the conveying path before arriving at the pressurizing/fixing means; and adjusting means for adjusting a gap between the image receiving medium and the heating/fusing means according to the characteristic of the image receiving medium passing the conveying path.

Further, according to the present invention, there is provided a fixing device comprising a pressurizing/fixing roller pair provided in the conveying path to lead an image receiving medium having a transferred developer image the exit direction for pressurizing/fixing the developer image by holding the image receiving medium; an endless belt shaped fixing belt having a first heater for heating/fusing the developer image in the conveying path before arriving at the pressurizing/fixing rollers; and an adjusting device for adjusting a gap between the image receiving medium and the fixing belt according to a characteristic of the image receiving medium passing the conveying path.

Further, according to the present invention, there is provided a heating volume adjusting method in a fixing device for heating/fixing a developer image formed on an image receiving medium by holding the image receiving medium by a pressurizing/fixing roller pair after heating and fusing the developer image by the fixing belt, comprising a step for adjusting a gap between the image receiving medium and the fixing belt according to a thickness of an image receiving medium.

BRIEF DESCRIPTION OF THE DRAWINGS

FIG. 4 is a diagram showing the fixing test results when a heat roller temperature and a second fixing roller temperature were controlled using ordinary paper in the fixing device shown in FIG. 2;

FIG. 5 is a diagram showing the fixing test results when a gap G1 between a fixing belt and a fixing guide was adjusted and a heat roller temperature and a second fixing roller temperature were controlled using a thick paper 1 in the fixing device shown in FIG. 2;

FIG. 6 is a diagram showing the fixing test results when the gap G1 between the fixing belt and the fixing guide was adjusted and the heat roller temperature and the second fixing roller temperature were controlled using a thick paper 2 in the fixing device shown in FIG. 2;

FIG. 7 is a diagram showing the fixing test result when the gap G1 between the fixing belt and the fixing guide was adjusted and the heat roller temperature and the second fixing roller temperature were controlled using a thick paper 3 in the fixing device shown in FIG. 2;

DETAILED DESCRIPTION OF THE PREFERRED EMBODIMENTS

Preferred embodiments of the present invention will be described below in detail referring to the attached drawings.

Figure 1:
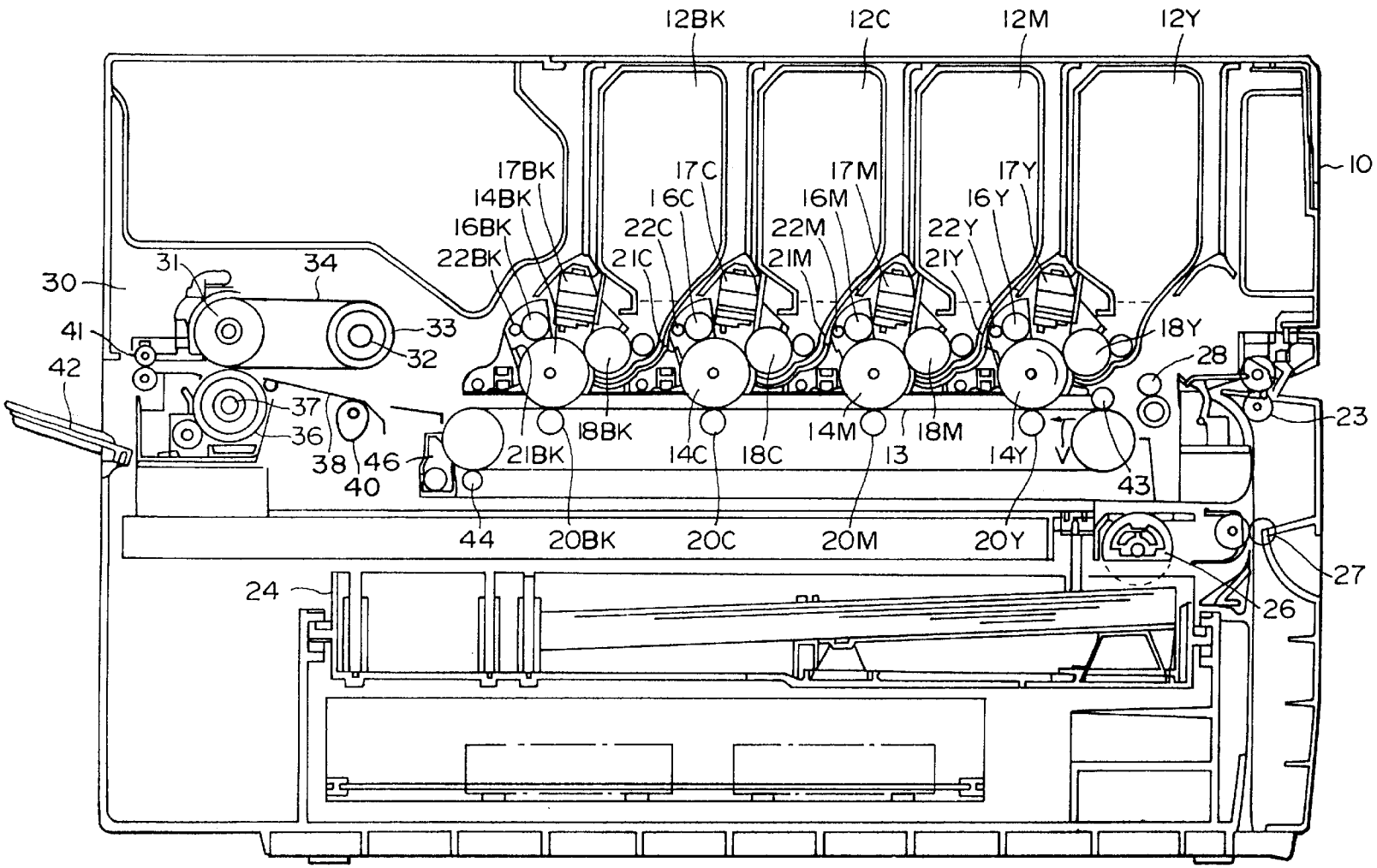
FIG. 1 is a block diagram schematically showing an image forming unit of a full color printer to which a fixing device in a first embodiment of the present invention is installed.

FIG. 1 is a schematic diagram showing an image forming unit 10 of a full color printer, which is a full color electrophotographic device to which a belt type fixing device is installed, that is a first embodiment of the present invention. In the image forming unit 10, 4 sets of recording devices 12Y, 12M, 12C, 12BK are deposited in a line along a transfer/conveyor belt 13, that is a paper conveying unit, for forming color images in respective colors using yellow (Y), magenta (M), cyan (C) and black (BK) toners.

The recording devices 12Y, 12M, 12C, 12BK are in the same structures and therefore, the recording devices will be described referring to the yellow (Y) recording device 12Y provided at the former stage and other recording devices 12M, 12C and 12BK will be assigned with the same reference numerals and subscripts showing respective colors to the same portions and the explanations thereof will be omitted.

The recording device 12 has a photosensitive drum 14Y and around it, there are arranged a charging device 16Y, an exposing device 17Y to apply yellow (Y) light signal, a developing device 18Y, a transferring roller 20Y, a cleaning device 21Y, and a charge eliminating device 22Y orderly along the rotating direction of the photosensitive drum 14Y. The transferring roller 20Y is arranged facing the photosensitive drum 14Y via the transferring/conveyor belt 13.

Further, below the recording devices 12Y, 12M, 12C and 12BK, there are a paper feed cassette device 24 for housing sheets of paper P that are image receiving media, a pickup roller 26 that picks up sheets of paper P from the paper feed cassette device 24 and feeds to the transferring/conveyor belt 13 at a proper timing, a feeding roller 27 and an aligning roller 28. The conveying speed of a paper P by the aligning roller 28 and the transfer/conveyor belt 13 is set equal to the peripheral speed of the photosensitive drums 14Y, 14M, 14C and 14BK.

Further, 23 is a manual paper feed roller to supply a paper P manually. Normally, the paper feed cassette device 24 supplies ordinary paper of 80 g/m$^2$~90 g/m$^2$, and thick paper 1 of 91 g/m$^2$~105 g/m$^2$, thick paper 2 of 106 g/m$^2$~140 g/m$^2$ and thick paper 3 of 141 g/m$^2$~209 g/m$^2$ are supplied by the manual paper feed roller 23.

Further, at the downstream side of the transferring/conveyor belt 13, there are provided a belt type fixing device 30, an exit roller pair 41 and a receiving tray 42. 43 is a absorbing roller to give electric charge to the transferring/conveyor belt 13 to absorb a paper P, 44 is a transferring/conveyor belt charge eliminating roller, and 46 is a transferring/conveyor belt cleaner.

Next, the belt type fixing device 30 will be described in detail. The fixing device 30 has a first fixing roller 31 having a rotary shaft 31*a* that is extending parallel to the paper P conveying surface and a first heater 32 comprising a halogen lamp, and an endless type fixing belt 34 is put over the first fixing roller 31 and a heat roller 33 that is installed so that the axial distance to the first fixing roller 31 becomes 80 mm.

Further, 36 is a second fixing roller that has a second heater 37 comprising a halogen lamp and is pressurized and brought in contact with the first fixing roller 31 at a pressing force 60 kg by a pressing part (not shown) via the fixing belt 34 and comprises a pressing/fixing roller pair jointly with the first fixing roller 31 for heating, pressurizing and fixing a toner image by clamping a sheet of paper P.

The first fixing roller 31 has an aluminum core metal in diameter 38 mm covered by an 1 mm thick highly heat resisting silicon rubber, and the heat roller 33 is made of an aluminum in diameter 40 mm having the first heater 32 at the core. The fixing belt 34 is made of an electro-formed 40 $\mu$m thick nickel coated with 240 $\mu$m thick silicon rubber. The second fixing roller 36 has an aluminum core metal in diameter 40 mm having the second heater 37 covered by a 30 $\mu$m thick heat resisting silicon rubber.

Normally, the first fixing roller 31 is set at a hardness lower than the hardness of the second fixing roller 36 so that a sheet of paper P does not wind around the first fixing roller 31 and is ejected facing downward. The first fixing roller 31 is rotated at a predetermined speed in the arrow direction "v" shown in the figure by a motor, etc. (not shown) and turns the fixing belt 34 in the arrow direction "w". Following the rotation of the fixing belt 34, the second fixing roller 36 is rotated in the arrow direction "x". The rotational speed of the fixing belt 34 is set at 100 mm/s.

The heat roller 33 and the second fixing roller 36 control the surface temperatures of the fixing belt 34 and the second fixing roller 36 to prescribed temperatures by turning the first and second heaters 32 and 37 ON/OFF, respectively.

Figure 2:
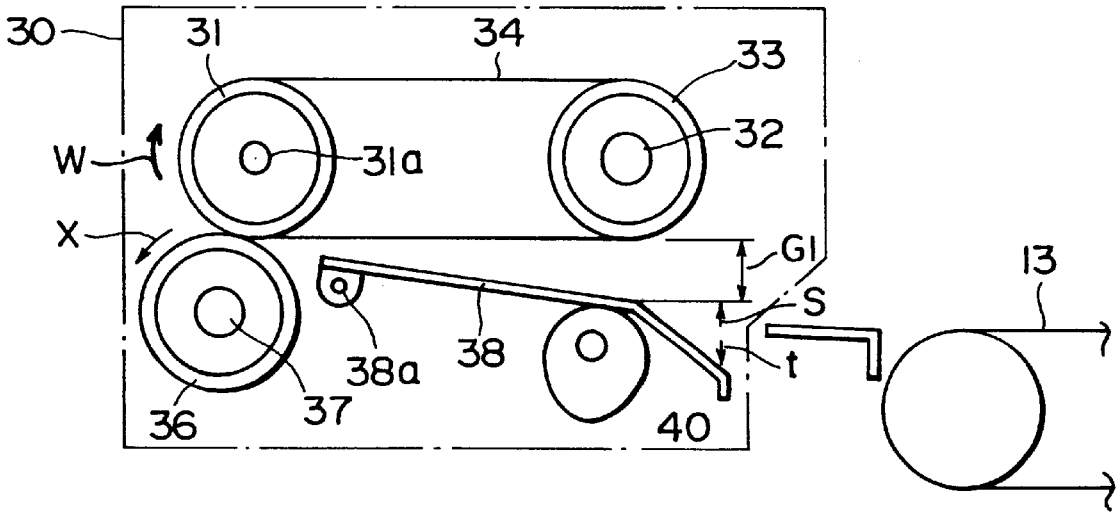
FIG. 2 is an explanatory diagram schematically showing a fixing device to which the first embodiment of the present invention is applied.

Below the fixing belt 34, there is provided a fixing guide 38 that is an adjusting device and a supporting guide able to oscillate in the arrow directions "s" and "t" shown in FIG. 2, centering around a supporting point 38*a* by a cam 40. The cam 40 is rotated as controlled by a signal from a CPU of the main body of a full color printer, adjusts the position of the fixing guide 38 and adjusts a gap between the fixing belt 34 and the fixing guide 38 according to a thickness of a paper P and adjusts the quantity of heat for heating and fusing a paper P.

Figure 3:
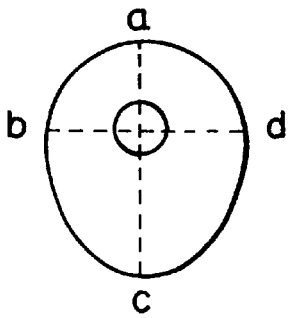
FIG. 3 is an explanatory diagram for showing a cam of the fixing device shown in FIG. 2.

That is, as shown in FIG. 3, the cam 40 is in such the structure that it is able to position 4 points of a, b, c and d at the positions where they are brought in contact with the fixing guide 38, and it is its home position where Point a is at the upper part and in contact with the fixing guide 38. At this time, the fixing guide 38 is at a position equivalent to the lowest position and the gap G1 between the fixing belt 34 and the fixing guide 38 becomes the maximum. The height of the fixing guide 38 when it is at this home position and the gap G1 between the fixing belt 34 and the fixing guide 38 becomes the maximum is the height of the fixing guide 38 when fixing ordinary paper of 80 g/m$^2$~90 g/m$^2$.

Regarding other heights of the fixing guide 38, the positions where Points b, c and d of the cam 40 are brought in contact with the fixing guide 38 are the heights of the fixing guide 38 when fixing the thick paper 1 of 91 g/m$^2$~105 g/m$^2$, the thick paper 3 of 141 g/m$^2$~209 g/m$^2$ and the thick paper 2 of 106 g/m$^2$~140 g/m$^2$, and the gap G1 between the fixing belt 34 and the fixing guide 38 is adjusted according to a thickness of paper in each class. Further, the fixing guide 38 is adjusted to respective heights according to a thickness of each paper and the heating volume to be applied to a paper P is adjusted and then, an image is fixed in respective paper thickness mode.

Next, the actual temperature control of the heat roller 33 and the second fixing roller 36 by the first and second heaters 32 and 37, and the position adjustment of the fixing guide 38 will be described in detail.

Generally, in the case of ordinary paper of 80 g/m$^2$~90 g/m$^2$, if the fixing guide 38 is brought too close to the fixing belt 34, there will be caused such a phenomenon that the trailing edge of a paper P is drawn to the fixing belt 34 by static electricity and a toner image that is not yet fixed is disordered and therefore, the gap G1 between the fixing belt 34 and the fixing guide 38 is required to be at least 10 mm.

Accordingly, when fixing tests of ordinary paper were conducted and the fixing property was checked with the gap G1 between the fixing belt 34 at the home position and the fixing guide 38 set at 10 mm, the results shown in FIG. 4 were obtained. That is, when the temperatures of the heat roller 33 were at 150° C. and 160° C. and the temperatures of the second fixing roller 36 were 140° C. and 150° C., good fixing property could be obtained without causing offset or jamming of paper P. Further, when considering the copying of both sides, since a good image is obtained without causing offset at the temperature of the second fixing roller 36 lower than the temperature of the heat roller 33 by 10° C., the temperature of the second roller 36 is set so that it becomes lower than the temperature of the heat roller 33 by 10° C.

Next, the position adjustment of the fixing guide 38 when fixing the thick paper 1 of 91 g/m$^2$~105 g/m$^2$, the thick paper 2 of 106 g/m$^2$~140 g/m$^2$ and the thick paper 3 of 141 g/m$^2$~209 g/m$^2$ will be described.

When the gap G1 between the fixing belt 34 and the fixing guide 38 was set at 10~6 mm and the best fixing temperatures of the heat roller 33 and the second fixing roller 36 for the thick paper 1 of 91 g/m$^2$~105 g/m$^2$ were tested and the results were obtained as shown in FIG. 5.

That is, when the gap G1 between the fixing belt 34 and the fixing guide 38 is the same as that when fixing the ordinary paper, in order to obtain good fixing property, the temperatures of the heat roller 33 and the second fixing roller 36 must be set high. However, if the gap G1 between the fixing belt 34 and the fixing guide 38 was set at 7 mm, it will be found that good fixing property is obtained without causing offset or jamming of paper even when the set temperatures of the heat roller 33 and the second fixing roller 36 are held at 160° C. and 150° C. that are the entirely same set temperatures at where good fixing property was obtained on ordinary paper as described above.

Then, when the gap G1 between the fixing belt 34 and the fixing guide 38 was adjusted to 10~3 mm and the best fixing temperatures of the heat roller 33 and the second fixing roller 36 at respective gaps were tested for the thick paper 2 of 106 g/m$^2$~140 g/m$^2$ and the thick paper 3 of 141 g/m$^2$~209 g/m$^2$ and the results were obtained as shown in FIG. 6 and FIG. 7.

That is, it will be found that good fixing property is obtained without causing offset or jamming of paper if the gap G1 between the fixing belt 34 and the fixing guide 38 is adjusted to 5 mm in the case of the thick paper 2 and to 3 mm in the case of the thick paper 3 even when the set temperatures of the heat roller 33 and the second fixing roller 36 are held at 160° C. and 150° C. that are the entirely same set temperatures at where good fixing property was obtained on ordinary paper as described above.

Further, in the above tests, to prevent the 1 mm thick silicon rubber coated on the core metal of the first fixing roller 31 from being peeled off or damaged, the temperature of the heat roller 33 was restricted to the maximum 200° C. Further, the gap G1 between the fixing belt 34 and fixing guide 38 was restricted to the minimum 3 mm taking the conveyance of a paper P into consideration.

As the results of the above tests, it was revealed that when fixing ordinary paper of 80 g/m$^2$~90 g/m$^2$, the thick paper 1 of 91 g/m$^2$~105 g/m$^2$, the thick paper 2 of 106 g/m$^2$~140 g/m$^2$ and the thick paper 3 of 141 g/m$^2$~209 g/m$^2$, the gap G1 between the fixing belt 34 and the fixing guide 38 was adjusted to 10 mm, 7 mm. 5 mm and 3 mm, respectively, good fixing property will be obtained for paper in any thickness even when the temperature of the heat roller 33 is kept constantly at 160° C. and the second fixing roller 36 constantly at 150° C.

Accordingly, in this first embodiment, based on the above-mentioned test results, by rotating the cam 40 according to a thickness of a paper to be used, the positions of the fixing guide 38 and the fixing belt 34 are adjusted so that the gap G1 between them is set at 10 mm by bringing Point a of the cam 40 in contact with the fixing guide 38 in the case of ordinary paper of 80 g/m$^2$~90 g/m$^2$, at 7 mm by bringing Point b of the cam 40 in contact with the fixing guide 38 in the case of the thick paper 1 of 91 g/m$^2$~105 g/m$^2$, at 5 mm by bringing the Point d of the cam 40 in contact with the fixing guide 38 in the case of the thick paper 2 of 106 g/m$^2$~140 g/m$^2$ and at 3 mm by bringing the Point c of the cam 40 in contact with the fixing guide 38 in the case of the thick paper 3 of 141 g/m$^2$~209 g/m$^2$.

Further, the rotation of the cam 40 for adjusting the position of the fixing guide 38 is controlled by selecting first~third change-over keys provided on the operation panel (not shown). That is, if any mode change-over key is not selected when image forming conditions are set when starting the image formation, it is recognized to be the image formation on ordinary paper and an image is fixed in the ordinary paper mode with the gap G1 between the fixing guide 38 and the fixing belt 34 at 10 mm. When a first mode change-over key was selected, it is recognized to be the image formation on the thick paper 1 and an image is fixed in the thick paper 1 mode with the gap G1 between the fixing guide 38 and the fixing belt 34 at 7 mm. Similarly, when the second or the third mode change-over key was selected, the image formation on the thick paper 2 or 3 is recognized and an image is fixed in the thick paper 2 mode with the gap G1 between the fixing guide 38 and the fixing belt 34 at 5 mm or the thick paper 3 mode with the gap G1 between the fixing guide 38 and the fixing belt 34 at 3 mm.

Further, in this first embodiment, the temperatures of the heat roller 33 and the second fixing roller 36 at the time of fixing are so set that they are constantly kept at 160° C. and 150° C., respectively.

Next, the operation will be described. When the start of the full color image formation is designated from the operation panel (not shown), operator sets image forming conditions such as the number of sheets of paper for image formation, magnification, etc. and when performing the copying by using paper other than ordinary paper of 80~90 g/m$^2$, selects paper P for forming an image from the thick paper 1 of 91 g/m$^2$~105 g/m$^2$, the thick paper 2 of 106 g/m$^2$~140 g/m$^2$ and the thick paper 3 of 141 g/m$^2$~209 g/m$^2$ by one of the first through third mode change-over keys on the operation panel (not shown) and selects the desired image forming mode.

When the copy key (not shown) is turned ON after setting required image forming conditions, image signals in respective colors are sent to the image forming units 10 and the yellow (Y), magenta (M), cyan (C) and black (BK) recording devices are operated at predetermined timings and toner images in respective colors, that are developer images, are formed on the photosensitive drums 14Y~14BK.

That is, when taking the yellow (Y) recording device 12Y as an example, with the rotation of the photosensitive drum 14Y in the arrow direction "u", the image forming processes are executed in order and the photosensitive drum is first electrified uniformly by the charging device 16Y. Then, the exposing operation is executed on this uniformly electrified photosensitive drum 14Y by the exposing device 17Y and a latent image corresponding to the yellow (Y) image signal is formed on the photosensitive drum 14Y. Thereafter, the photosensitive drum 14Y is developed by the developing device 18Y and a yellow (Y) toner image is formed on the photosensitive drum 14Y.

Similarly, in the magenta (M), cyan (C) and black (BK) Recording devices 12M. 12C and 12BK, toner images in respective colors are formed on the photosensitive drums 14M, 14C and 14BK.

On the other hand, synchronous with the formation of toner images in respective colors on the photosensitive drums 14Y, 14M, 14C and 14BK, the pickup roller 26 or the manual paper feed roller 23 is driven and a paper P is supplied from the paper feed cassette device 24 or manually. This paper P is sent to the transferring/conveyor belt 13 after the leading edge is aligned by the aligning roller 28.

The paper P sent to the transferring/conveyor belt 13 is applied with electric charge by the absorbing roller 43 and conveyed in the arrow direction "v" with the running of the transferring/conveyor belt 13 in the state electro-statically absorbed to the conveyor belt 13. The paper P is first fed into a yellow toner image transferring position, that is, a position where the photosensitive drum 14Y faces the transferring roller 20Y with the transferring/conveyor belt 23 between them. The paper P is brought in contact with the yellow toner image formed on the photosensitive drum 14Y at this yellow toner image transferring position. Then, the yellow toner image formed on the photosensitive drum 14Y is transferred on the paper P from this state by the action of the transferring roller 20Y.

The transferring roller 20Y has semi-conductivity and supplies an electric field having the polarity reverse to the potential of the yellow toner image that is adhered electrostatically to the photosensitive drum 14Y to the transferring/conveyor belt 13 through its back side. This electric field acts on the yellow toner image on the photosensitive drum 14Y through the transferring/conveyor belt 13 and the yellow toner image is transferred on the paper P from the photosensitive drum 14Y. The paper P with the yellow toner image thus transferred is then conveyed to the toner image transferring positions of the magenta recording device 12M, the cyan recording device 12C and the black recording device 12BK in order. In the same manner as above, a magenta toner image, a cyan toner image and a black toner image are multi-transferred on the paper P in order in the similar manner as above and a full color toner image is formed. The paper P with the full color toner image formed is peeled off from the transferring/conveyor belt 13 and sent to a fixing device 30, where a full color toner image formed in superposed colors is permanently fixed.

After this permanent fixing, the paper P is carried out on the receiving tray 32. On the other hand, after the paper P is peeled off, the transferring/conveyor belt 13 is continuously driven to rotate and residual toner and paper powder are cleaned by a belt cleaner 46. After this cleaning, the electric charge applied to the transferring/conveyor belt 13 is eliminated by the transferring/conveyor belt charge eliminating roller 44 so that the surface potential of the belt is kept constant.

Further, the photosensitive drums 14Y, 14M, 14C and 14BK are continuously rotated and driven after the toner images are transferred and residual toners and paper power are cleaned by the cleaners 21Y, 21M, 21C and 21BK. After this cleaning, the charge applied to the photosensitive drums 14Y, 14M, 14C and 14BK are eliminated by the charge eliminating device 22Y, 22M, 22C and 22BK so that the surface potential of the drums is kept constant and are put in the standby state for the next full color image forming process.

Next, actions of the fixing device 30 will be described. When the power source of the image forming unit 10 is turned ON and the warm-up is started, the first heater 32 and the second heater 37 are turned ON for preheating the fixing belt 34 and the second fixing roller 36, the fixing belt 34 is rotated in the arrow direction "w" at a speed as high as, for instance, 100 mm/sec. and following this rotation of the fixing belt, the second fixing roller 36 is rotated in the arrow direction "x". When the heat roller 33 reaches 160° C. and the second fixing roller 36 reaches 150° C. as a result of this warm-up, the image forming unit 10 becomes the ready state.

After the image forming unit 10 becomes the ready state, the fixing belt 34 is rotated at a speed as low as 50 mm/sec. and by turning the first heater 32 and the second heater 37 ON/OFF, the temperatures are controlled so as to maintain the heat roller 33 at 160° C. and the second fixing roller 36 at 150° C. Further, in this ready state, the fixing guide 38 is adjusted to the home position where Point a of the cam 40 is brought in contact with it and the gap G1 with the fixing belt 34 is 10 mm.

Then, when the start of the image formation is designated and the full color image forming conditions are set through the operation panel, if the paper mode is the ordinary paper mode using ordinary paper of 80 $g/m^2$~90 $g/m^2$ without selecting any of the first through third mode change-over keys (not shown), the rotation of the cam 40 is not controlled and the fixing guide 38 is kept at the home position.

On the other hand, when the first~third change-over key (not shown) input is made when setting image forming conditions, the cam 40 is rotated corresponding to the mode change-over key input. When the first mode change-over key input is made, the cam 40 is rotated to bring Point b in contact with the fixing guide 38 and oscillates and adjusts the gap G1 between the fixing guide 38 and the fixing belt 34 to 7 mm.

When the second mode change-over key input is made, the cam 40 is rotated to bring Point d in contact with the fixing guide 38 and oscillates and adjusts the gap G1 between the fixing guide 38 and the fixing belt 34 to 5 mm. When the third mode change-over key input is made, the cam 40 is rotated to bring Point c in contact with the fixing guide 38 and oscillates and adjusts the gap G1 between the fixing guide 38 and the fixing belt 34 to 3 mm. This rotational control of the cam 40 is completed in several seconds.

When the copying operation is started by turning the copy key (not shown) in this state, the fixing belt 34 and the second fixing roller 36 following thereto are rotated at the fixing speed of 100 mm/sec. in the fixing device 30, sheets of paper P on which a full color toner image is transferred in the above-mentioned full color image forming process and conveyed on the transferring/conveyor belt 13 are supported and guided in the directions of the fixing rollers 31, 36 by the position adjusted fixing guide 38 according to the thickness of the paper P and the full color toner images on the sheets of paper P are heated and fused by the fixing belt 34 that is heated to 160° C. during this period. Further, the sheets of paper with the full color toner images heated and fused are inserted between the first fixing roller 31 and the second fixing roller 36 that is heated to 150° C. and the full color toner image is heated, pressurized and fixed.

That is, when fixing an image, as the heating volume to be applied to a paper P according to its thickness is adjustable by adjusting the gap G1 between the fixing belt 34 and the fixing guide 38 according to a thickness of a paper P, a full color toner image is applied with a sufficient heating volume when passing through the gap G1 and sufficiently heated and fused even when the image formation is executed using sheets of paper P in any thickness and then, heated, pressurized and fixed between the first fixing roller 31 and the second fixing roller 36. Thus, the good fixing property is obtained on a paper P in any thickness.

Thus, by adjusting the gap G1 between the fixing belt 34 and the fixing guide 38 by oscillating the fixing guide 38 according to a thickness of a paper, the heating volume to be applied to a paper P that is running on the fixing guide 38 can be adjusted easily in a very short time without adjusting the conveying speed of a paper P or adjusting the heating temperature by the fixing belt while maintaining the copying speed and fixing temperature constant. Accordingly, irrespective of difference in paper thickness, a full color image is obtained efficiently without deteriorating the performance of the image forming apparatus due to drop in the number of sheets of paper to be copied resulting from drop in copying speed. Furthermore, a long standby time is not required when changing over the image forming mode and the operability of the image forming apparatus can be improved as a result of the reduced waiting time.

Next, a second embodiment of the present invention will be explained. In the second embodiment, the heating volume to be applied to a paper P is regulated by adjusting a gap between the fixing belt and fixing guide by oscillating the fixing belt instead of the fixing guide that is used in the first embodiment for adjusting the gap according to thickness of a paper P.

Further, in this second embodiment, the fixing belt is extended more longer in order to obtain the good fixing property by sufficiently heating and fusing a full color toner image that is formed by superposing yellow (Y), magenta (M), cyan (C) and black (BK) toners in the first embodiment and on the other hand, when the fixing belt is partially overlapped on the end of the transferring/conveyor belt in order for preventing the image forming unit from becoming a large in size, the fixing belt is separated from the transferring/conveyor belt in order for preventing the transferring/conveyor belt from being heated and deteriorated by the fixing belt, when a toner image is not heated, fused and fixed by the fixing belt and at least no paper is conveyed and the transferring/conveyor belt is stopped to be driven.

Further, in this second embodiment, the same component elements as those in the first embodiment are assigned with the same reference numerals and the detailed explanations thereof are omitted.

Figure 8:
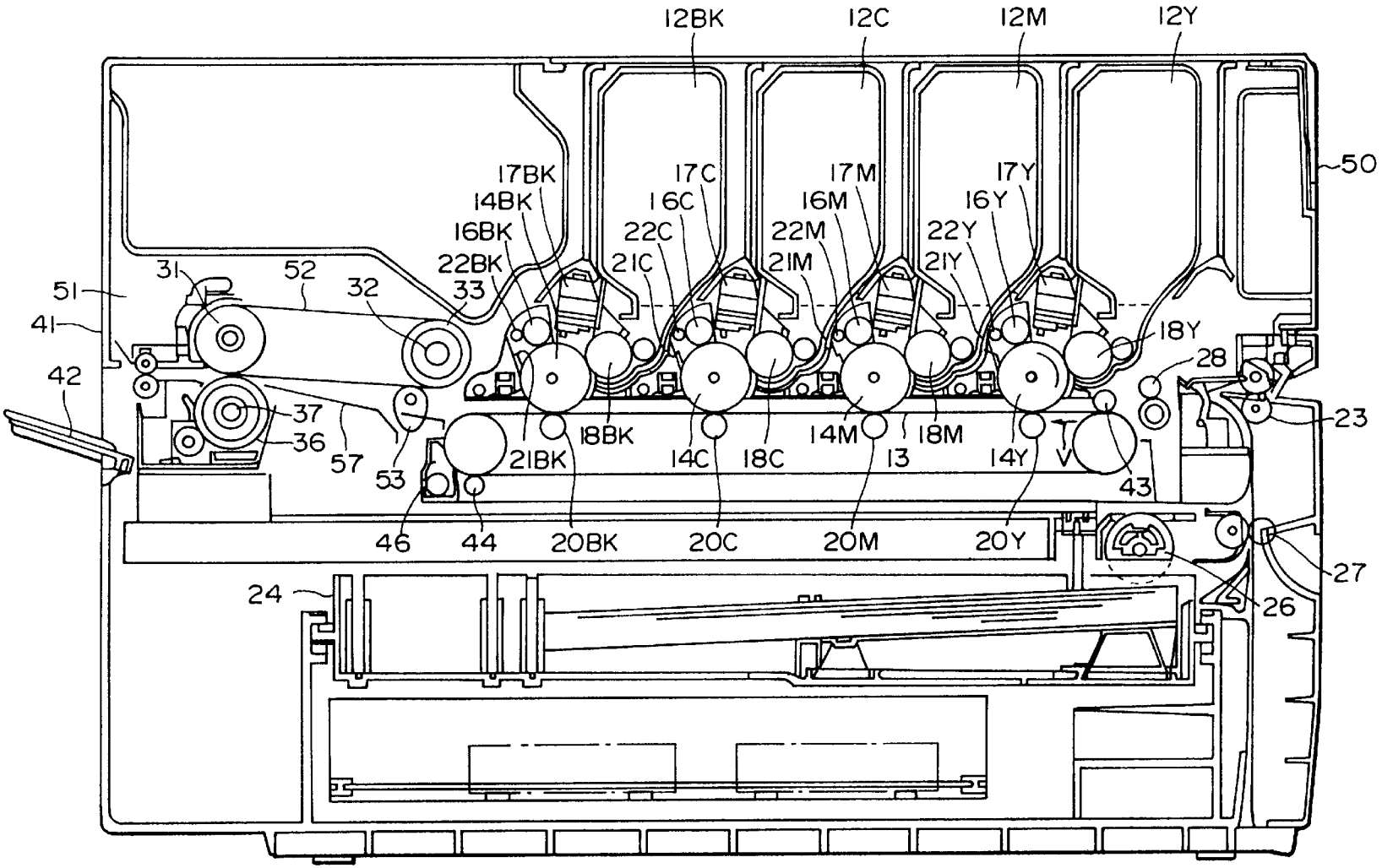
FIG. 8 is a block diagram schematically showing an image forming unit of a full color printer to which the fixing device of the second embodiment of the present invention is installed.

FIG. 8 is a schematic diagram showing an image forming unit 50 of a full color printer that is a full color electrophotographic printer equipped with a belt type fixing device of the second embodiment of the present invention. In a fixing device 51, the first fixing roller 31 and the heat roller 33 are installed so that a distance between their shafts becomes 120 mm and a fixing belt 52 is put over both rollers 31, 32. The end of the fixing belt 52 of the heat roller 22 side is overlapped on the end f the transferring/conveyor belt 13. Further, 57 is a stationary fixing guide.

The first fixing roller 31, the heat roller 33 and the fixing belt 52 are supported in one united body by a frame 54 that is able to oscillate in the directions of arrow marks "m" and "n" centering around a supporting point 54*a* by a cam 53 and comprise a fixing belt unit 56. 58 is a pressurizing spring to constantly press the frame 54 down against the cam 53.

The cam 53 is controlled to rotate by a signal from a CPU of the main body of the full color printer so as to position five points of e, f, g, h and i at the locations where they contact the frame 54, oscillates the frame 54 against the pressurizing spring 58, adjusts the position of a gap G2 between the fixing belt 52 and the stationary fixing 57 according to a thickness of a paper P and regulates the heating volume for sufficiently heating and fusing a paper P. Further, when the transferring/conveyor belt 13 is stopped, the cam 53 separates the heat roller 33 side end of the fixing belt 52 from the end of the transferring/conveyor belt 13 by oscillating the position of the frame 54.

Figure 9:
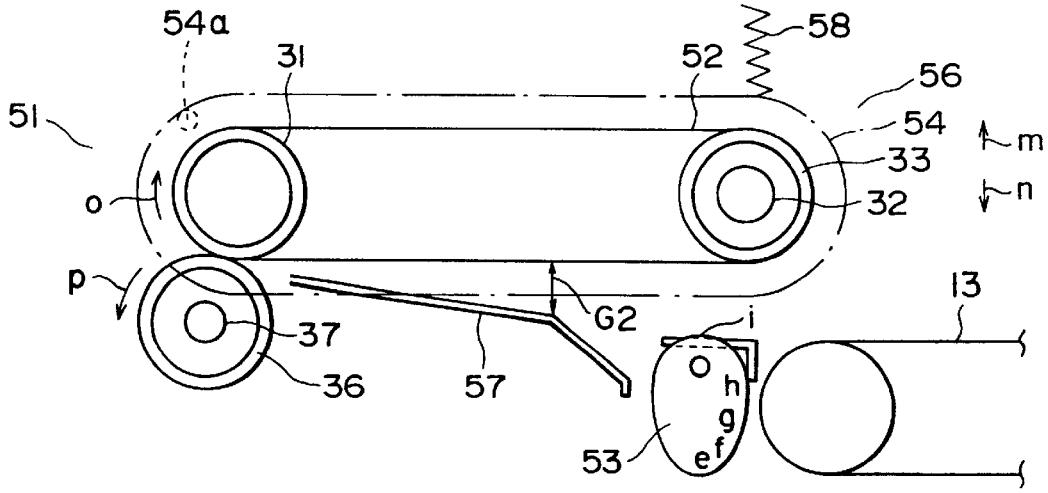
FIG. 9 is an explanatory diagram schematically showing a fixing device at the time of fixing, to which the second embodiment of the present invention is applied.
Figure 10:
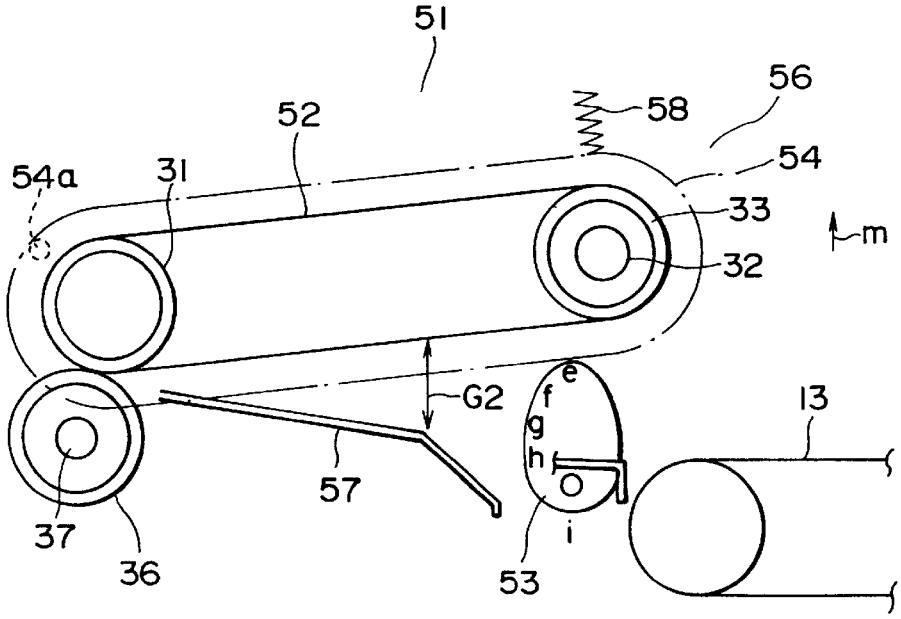
FIG. 10 is an explanatory diagram schematically showing a fixing device at the time of non-fixing, to which the second embodiment of the present invention is applied.

That is, as shown in FIG. 10, when Point e of the cam 53 is at the upper part and the frame 54 is fully oscillated in the arrow direction "m", this position is the home position of the cam 53. At this home position, the heat roller 33 side end of the fixing belt 52 is separated from the transferring/conveyor belt 13 by about 30 mm. On the other hand, as shown in FIG. 9, when Point i of the cam 53 is positioned at the upper part and the cam 53 is separated from the frame 54, the gap G2 between the fixing belt 52 and the fixing guide 57 is adjusted to minimum 3 mm so that the fixing belt 52 fixes the thick paper 3.

Further, when Point f of the cam 53 is in contact with the frame 54, the fixing belt 52 is adjusted to a position so that the gap G2 with the fixing guide 57 becomes 10 mm so as to fix ordinary paper. Similarly, when Point g or h of the cam 53 is in contact with the frame 54, the position of the fixing belt 52 is adjusted so that the gap G2 with the fixing guide 57 becomes 7 mm or 5 mm so as to fix the thick paper 1 or 2.

The rotation of the cam 53 for adjusting the position of the fixing belt 52 by oscillating the frame 54 is so controlled that Point e of the cam 53 is always positioned at the home position where it is in contact with the frame 54 when no image is formed and the transferring/conveyor belt 13 is stopped. On the other hand, during the copying operation, the rotation of the cam 53 is controlled by selecting fourth~sixth mode change-over keys on the operation panel (not shown). That is, when the mode change-over key is not selected during the copying operation, it is recognized to be the image formation on ordinary paper and the cam 53 is rotated so that Point f is brought in contact with the frame 54. When the fourth mode change-over key is selected, it is recognized to be the image formation on the thick paper 1 and the cam 53 is rotated so that Point g is brought in contact with the frame 54. When the fifth mode change-over key is selected, it is recognized to be the image formation on the thick paper 2 and the cam 53 is rotated so that Point h is brought in contact with the frame 54. When the sixth mode change-over key is selected, it is recognized to be the image formation on the thick paper 3 and the cam 53 is rotated so that Point i is positioned at the upper part and is separated from the frame 54.

Next, the fixing process of the fixing device 51 will be described. When the power source of the image forming unit 10 is turned ON, the frame 54 is adjusted to position at the home position where Point e of the cam 53 is brought in contact with it, and the heat roller 33 side end of the fixing belt 52 is separated from the transferring/conveyor belt 13 by about 30 mm. In this state, the warm-up starts, the first and second heaters 32 and 37 are turned ON for preheating the fixing belt 52 and the second fixing roller 36, the fixing belt 52 is rotated in the arrow direction "o" at a high speed of, for instance, 100 mm/sec. and following the rotation of the fixing belt 52, the first fixing roller 36 is rotated in the arrow direction "p".

When the heat roller 33 and the second fixing roller 36 reach 160° C. and 150° C., respectively as a result of this warm-up, the image forming unit 50 becomes the ready state.

After this ready state, the fixing belt 52 is rotated at a low speed of 50 mm/sec. and the heat roller 33 and the second fixing roller 37 are kept at 160° C. and 150° C., respectively by turning the first and second heaters 32 and 37 ON/OFF.

Then, when the start of the image formation is designated and the copy key (not shown) is turned ON, the recording devices 12Y, 12M, 12C and 12BK of the image forming unit 10 are operated at predetermined timings and the transferring/conveyor belt 13 is rotated in the arrow direction "v".

On the other hand, in the fixing device 51, if the mode change-over key (now shown) input was not made from the operation panel when setting the image forming conditions at the time to designate the start of image formation, the cam 53 is rotated to a position where Point f is brought in contact with the frame 54 from the home position, the gap G2 between the fixing belt 52 and the fixing guide 57 is adjusted to 10 mm, and it becomes possible to fix an image on ordinary paper. Further, when the fourth or fifth mode change-over key (not shown) is set at the time when setting the image forming conditions, the cam 53 is rotated to a position where Point g or h of the cam 53 is brought in contact with the frame 54, the gap G2 between the fixing belt 52 and the fixing guide 57 is adjusted to 7 mm or 5 mm, and the fixing of the thick paper 1 or 2 becomes possible.

Further, when the sixth mode change-over key is set when setting the image forming conditions, the cam 53 is rotated to a position where Point i is positioned at the upper part and is separated from the frame 54. As a result, the gap G2 between the fixing belt 52 and the fixing guide 57 is adjusted to 3 mm and the fixing of the thick paper 3 becomes possible. Further, the rotation of the cam 53 is completed in several seconds.

Then, when the copy key (not shown) is turned ON and the copying operation starts, in the fixing device 51, the fixing belt 52 and the following second fixing roller 36 are rotated at a fixing speed of 100 mm/sec., a full color toner image formed on the paper is sufficiently heated and fused by the fixing belt 34 that is heated to 160° C. while guiding and supporting a sheet of paper P conveyed by the transferring/conveyor belt 13 by the fixing guide 57 and a sheet of paper P having a sufficiently heated and fused toner image is passed between the first fixing roller 31 and the second fixing roller 36 that is heated to 150° C. and a full color toner image is heated, pressurized and fixed.

That is, because the heating volume applied to a paper P is adjustable according to a thickness of a paper P by adjusting the gap G2 between the fixing belt 52 and the fixing guide 57 according to a thickness of a paper P when fixing, a full color toner image is applied with a sufficient heating volume and thoroughly heated and fused while passing through the gap G2 even when an image is formed using any paper P, good fixing property is obtained on a paper in any thickness when heated, pressurized and fixed between the first and second fixing rollers 31 and 36.

Thereafter, when the image forming process is completed, the recording devices 12Y, 12M, 12C and 12BK are stopped and the transferring/conveyor belt 13 is also stopped to rotate. At this time, in the fixing device 51, the rotation of the cam 53 is so controlled that Point e is brought in contact with the frame 54 and the heat roller 33 side end of the fixing belt 52 is returned to the home position that is separated from the transferring/conveyor belt 13 by about 30 mm. Accordingly, although the transferring/conveyor belt 13 is stopped to run, the fixing belt 52 is separated from the transferring/conveyor belt 13 and the transferring/conveyor belt 13 will not be deformed partially by the heated fixing belt 52.

Thus, by adjusting the gap G2 between the fixing belt 52 and the fixing guide 57 by oscillating the fixing belt 52 according to a thickness of a paper P, the heating volume to be given to a paper P running on the fixing guide 57 can be adjusted easily in a short time while keeping the copying speed and the fixing temperature constant. Accordingly, irrespective of difference in a paper thickness, a full color image can be obtained at a high performance without deterioration of a performance of an image forming apparatus resulting from decrease in the number of copies due to reduced copying speed. Further, a long waiting time is not required when changing an image forming mode according to a paper thickness and it becomes possible to improve the operability by making a waiting time short.

Furthermore, when the fixing belt 52 is arranged partially to overlap the transferring/conveyor belt 13 so as not to make the image forming unit 51 large when using a long fixing belt 52 to extend a heating distance for sufficiently heating and fusing toners, the fixing belt 52 is always kept separated from the transferring/conveyor belt 13 as long as the transferring/conveyor belt 13 is stopped to run when no image is fixed. Therefore, it is possible to prevent the thermal deformation of the transferring/conveyor belt 13 by the heating of the fixing belt 52. Accordingly, because the thermal deformation of the transferring/conveyor belt 13 is prevented, it is not necessary to excessively drive the transferring/conveyor belt 14 and the photosensitive drums 14Y, 14M, 14C, 14BK that are rotated synchronously with the transferring/conveyor belt 13 when no paper is conveyed. Thus, the life of the transferring/conveyor belt 13 and the photosensitive drums 14Y, 14M, 14C, 14BK can be extended and a low cost can be achieved as a result of the prevention of unnecessary driving.

Further, the present invention is not restricted to the above-mentioned embodiments but can be modified variously within the scope of the present invention. For instance, in the above embodiments, the heating volume to be given to a paper is regulated by adjusting the gap between the fixing belt and the supporting belt according to a thickness of paper; however, in order for regulating the heating volume to be given to paper, the gap is adjustable according to characteristics of paper such as ordinary paper and OHP paper.

Further, the present invention is also not restricted to thickness of paper to be used. When other paper than the paper used in the above embodiments is used and the gap cannot be made smaller than the specified widths in order to retain the paper conveying property, the gap may be set at the minimum width and on the other hand, the fixing belt and fixing roller may be heated up to proper temperatures so as to obtain good fixing property. Although a time is needed for the temperature regulation of the fixing belt and the fixing roller at this time, it is limited to adjust only the insufficient heating volume that cannot be covered by the gap and therefore, a time required for the temperature adjustment can be reduced remarkably more than before and a waiting time at the time of mode change-over also can be reduced remarkably and thus, the improved operability is obtained.

Further, in the second embodiment the deformation of the transferring/conveyor belt is prevented by oscillating the fixing belt in multiple stages and the gap between the fixing belt and the fixing guide is adjusted; however, the gap between the fixing belt and the fixing guide may be adjusted by oscillating the fixing guide and the fixing belt may be oscillated only when separating it from the transferring/conveyor belt for preventing the thermal deformation of the belt. Further, if the heating and fusing of a toner image by the fixing belt is sufficient enough, it may not be necessary to provide a heater to the fixing roller.

According to the present invention as described above in detail, the heating volume suited to various kinds of paper becomes adjustable easily in a very short time by adjusting the gap between the heating/fusing device and the image receiving medium, the operability when forming a full color image can be improved without requiring a long waiting time for changing an image forming mode and also, a full color image can be obtained in a high performance without causing drop in the number of image forming sheets.

Further, according to the present invention, as toners are sufficiently heated and fused, even when a part of a long heating/fusing device is arranged by overlapping a conveying device at the upper stream, the heating/fusing device is separated from the conveying device when no image is fixed and at least the conveying device is stopped, the thermal deformation of the conveying device can be prevented. Accordingly, when no paper is conveyed, it is not required to drive the conveyor belt and the photosensitive drums that are driven synchronously with the conveyor belt, and a long life of the conveying device and the photosensitive drums and low cost can be achieved.

What is claimed is:

1. A fixing device comprising:

roller shaped pressurizing and fixing means provided in a conveying path to lead an image receiving medium having a developer image in the exit direction for pressurizing and fixing the developer image by holding the image receiving medium;

endless belt shaped heating/fusing means having a first heater for heating and fusing the developer image in the conveying path before arriving at the pressurizing/fixing means; and adjusting means for adjusting a gap between the image receiving medium and the heating/fusing means according to a characteristic of the image receiving medium passing the conveying path.

2. A fixing device according to claim 1, wherein the adjusting means adjusts the gap between the image receiving medium and the heating/fusing means to a narrow width with the image receiving medium becoming thicker.

3. A fixing device according to claim 1, wherein supporting means is further provided for supporting the image receiving medium at a position opposite to the heating/fusing means in the conveying path and the adjusting means adjusts the supporting means to partial to the heating/fusing means side with the image receiving medium becoming thicker.

4. A fixing device according to claim 1, wherein the adjusting means adjusts the heating/fusing means to partial to the image receiving medium with it becoming thicker.

5. A fixing device according to claim 1, wherein the heating/fusing means is separated from conveying means provided at the upper stream of the conveying path when the fixing operation is not executed, and the adjusting means adjusts the gap between the image receiving medium and the heating/fusing means with the image receiving medium becoming thicker.

6. A fixing device according to claim 1, wherein the pressurizing/fixing means further includes a second heater for heating the image receiving medium from the reverse side of the developer image transferred surface and heats, pressurizes and fixes, and the adjusting means adjusts the gap between the image receiving medium and the heating/fusing means to a narrow width with the image receiving medium becoming thicker.

7. A fixing device according to claim 1, wherein the developer image is a color developer image formed by piling up plural color developers, the pressurizing/fixing means comprises first pressurizing/fixing means and second pressurizing/fixing means that has a second heater to heat the image receiving medium from the reverse surface of the color developer transferred surface and holds the image receiving medium together with the first pressurizing/fixing means and heats, pressurizes and fixes the developer image, the heating/fusing means is put over between the first pressurizing/fixing means and the first heater;

supporting means is further provided at a position opposite to the heating/fusing means in the conveying path for supporting the image receiving medium, and the adjusting means adjusts the image supporting means so that it is one-sided to the heating/fusing means side with the image receiving medium becoming thicker.

8. A fixing device according to claim 7, wherein the heating/fusing means raises the heating/fusing temperature of the developer image with the image receiving medium becoming thicker.

9. A fixing device according to claim 7, wherein the heating/fusing means is separated from the conveying means provided at the upper stream side of the conveying path when the fixing operation is not executed.

10. A fixing device comprising:

a pressuring/fixing roller pair provided in the conveying path to lead an image receiving medium having a developer image in the exit direction for pressurizing/fixing the developer image by holding the image receiving medium;

an endless belt shaped fixing belt having a first heater for heating/fusing the developer image in the conveying path before arriving at the pressurizing/fixing roller pairs; and an adjusting device for adjusting a gap between the image receiving medium and the fixing belt according to the characteristic of the image receiving medium passing the conveying path.

11. A fixing device according to claim 10, wherein the adjusting device adjusts a gap between the image receiving medium and the fixing belt with the image receiving medium becoming thicker.

12. A fixing device according to claim 10, wherein a supporting guide is further provided at a position opposite to the fixing belt of the conveying path for supporting the image receiving medium, and the adjusting device adjusts the supporting guide so that it is one-sided to the fixing belt side with the image receiving medium becoming thicker.

13. A fixing device according to claim 10, wherein the adjusting device adjusts the fixing belt so that it is one-sided to the image receiving medium side with the image receiving medium becoming thicker.

14. A fixing device according to claim 10, wherein the fixing belt is separated from the conveying means provided at the upper stream side of the conveying path when the fixing operation is not executed, and the adjusting device adjusts a gap between the image receiving medium and the fixing belt to a narrow width with the image receiving medium becoming thicker.

15. A fixing device according to claim 10, wherein the pressurizing/fixing roller has further a second heater for heating the image receiving medium from the opposite side of the developer image transferred surface and heats, pressurize and fixes the developer image, and the adjusting device adjusts a gap between the image receiving medium and the fixing belt to a narrow width with the image receiving medium becoming thicker.

16. A fixing device according to claim 10, wherein the developer image is a color developer image formed by piling up plural color developers, the pressurizing/fixing roller comprises a first pressurizing/fixing roller and a second pressurizing/fixing roller having a second heater for heating the image receiving medium from the reverse side surface of the color developer image transferred surface and holding the image receiving medium together with the first pressurizing/fixing roller and heats, pressurizes and fixes the developer image, the fixing belt is put over between the first pressurizing/fixing roller and the heat roller having the built-in first heater, a supporting guide for supporting the image receiving medium is further provided at a position opposite to the fixing belt of the conveying path, and the adjusting device adjusts the supporting guide so that it is one-sided to the fixing belt side by the rotary cam with the image receiving medium becoming thicker.

17. A fixing device according to claim 16, wherein the fixing belt raises the heating/fusing temperature of the developer image with the image receiving medium becoming thicker.

18. A fixing device according to claim 16, wherein the fixing belt is separated from the conveying means provided at the upper stream side of the conveying path when the fixing operation is not executed.

19. A heating volume regulating method in a fixing device for heating, pressurizing and fixing a developer image by holding an image receiving medium that is heated and fused by a pressurizing/fixing roller pair after heating and fusing the developer image formed on an image receiving medium, comprising the step of:

adjusting a gap between the image receiving medium and the fixing belt according to a thickness of the image receiving medium.

20. A heating volume regulating method in the fixing device according to claim 19, wherein the gap adjusting step adjusts a gap between the image receiving medium and the fixing belt so that it is narrowed with the image receiving medium becoming thicker.

* * * * *